United States Patent [19]

Seragnoli

[11] Patent Number: 4,499,909

[45] Date of Patent: Feb. 19, 1985

[54] CIGARETTE MANUFACTURING MACHINE

[75] Inventor: Enzo Seragnoli, Bologna, Italy

[73] Assignee: G.D Societa' per Azioni, Bologna, Italy

[21] Appl. No.: 243,137

[22] Filed: Mar. 12, 1981

[30] Foreign Application Priority Data

Apr. 8, 1980 [IT] Italy ..... 48353 A/80

[51] Int. Cl.[3] ..... A24C 5/18

[52] U.S. Cl. ..... 131/84 R; 84 C/108; 84 C/109 R; 84 C/110

[58] Field of Search ..... 131/84 R, 84 C, 84 B, 131/84 A, 109 R, 110, 108

[56] References Cited

U.S. PATENT DOCUMENTS 2,841,154 7/1958 Dearsley ..... 131/109 R 3,996,943 12/1976 Hinzmann ..... 131/109 R 4,185,644 1/1980 Heitmann et al. ..... 131/109 R 4,223,685 9/1980 Labbe ..... 131/109 R

*Primary Examiner*—Vincent Millin

*Attorney, Agent, or Firm*—Marshall, O'Toole, Gerstein, Murray & Bicknell

[57] ABSTRACT

A cigarette manufacturing machine having at least one manufacturing unit in which shredded tobacco is fed into a chamber laterally bounded by a carding unit and provided with a base wall defined by a substantially horizontal belt which is movable towards said carding unit and terminates substantially at a zone of tangency between two superposed carding rollers; each manufacturing unit having, in common with each other manufacturing unit, controls for operating the relative carding unit.

10 Claims, 4 Drawing Figures

CIGARETTE MANUFACTURING MACHINE

BACKGROUND OF THE INVENTION

This invention relates to a cigarette manufacturing machine.

As is well known, cigarette manufacturing machines normally comprise a tobacco distributor, i.e. a unit the purpose of which is to transform a mass of shredded tobacco into a substantially constant continuous stream of separate tobacco particles, by successive processing stages. This stream of tobacco particles is fed either directly or by means of a belt conveyor to the lower end of a duct normally disposed in a vertical position. The upper end of said vertical duct is normally closed by a suction conveyor belt which connects the distributor to a final section of the manufacturing machine, and extends beyond the mouth of said vertical duct to reach a position, defined as the discharge position, disposed where the suction conveyor meets the feed track for a cigarette paper web.

Under the thrust of a rising air current, the tobacco particles constituting the stream generated by the distributor rise up the vertical duct and adhere to the suction conveyor belt, to form a layer or filler thereon by accumulation. The effect of the suction causes this filler to be retained by the suction belt, which transfers it from the mouth of the vertical duct to said discharge position, at which it is deposited on to the cigarette paper web.

Over that portion of its path between the vertical duct and the discharge position, the tobacco filler is subjected to a trimmer device, the purpose of which is to make its thickness substantially uniform.

From British Pat. No. 961,139 it is known to use a distributor comprising a funnel-shaped chamber or hopper for accumulating a mass of tobacco, which is defined at one end by a fixed inclined wall and at the other end by a carding unit having two rollers, known respectively as the carding and brushing rollers, and provided with teeth. These rollers rotate in the same direction substantially tangential to each other. The carding roller has a direction of rotation such as to withdraw the tobacco from the inside of the hopper in order to transfer it to the outside thereof downstream of the zone of tangency or interaction with the brushing roller. The purpose of the brushing roller is to reduce the tobacco transferred to the outside of the hopper by the carding roller, to a substantially uniform layer which is fed in known manner to the vertical duct in the form of a continuous and substantially uniform stream of tobacco particles.

A chamber for containing a mass of shredded tobacco is disposed above the funnel-shaped hopper and the carding unit. The chamber is bounded at the bottom by a conveyor belt, and on two sides by a fixed wall and an elevator belt consisting of the rising run of an endless belt. By means of teeth or blades fitted to its surface, the elevator belt withdraws tobacco from the inside the chamber, and deposits it, by means of its descending run, into said funnel-shaped chamber. During this transfer, the tobacco is subjected to a preliminary carding operation by two toothed rollers cooperating with the elevator belt.

The critical point of the described distributor is the funnel-shaped hopper for feeding the tobacco to the carding unit. The hopper comprises a vessel of substantially constant volume bounded by fixed and mobile walls, between which a mass of tobacco remains for prolonged periods of time, during which it is subjected to a continuous turning action and to high compression. This treatment leads to the formation of tangled tobacco particles (known as knots or cords) with partial nullification of the effects of the preliminary carding operation. A further serious consequence of this treatment is that tobacco particles having different physical characteristics separate at different levels. More precisely, the longer particles from shredding of the blade part of the tobacco leaf tend to concentrate in the top of the hopper. In contrast, the shorts originating both during said shredding operation and from crumbling of the longer particles during subsequent treatment stages to which the tobacco is subjected, tend to fall gradually and accumulate in the base of the hopper. In particular, because of the prolonged compression and turning action to which the tobacco mass is subjected, the percentage of shorts in hoppers of the described type reaches extremely high values.

Because of their distribution in different layers in the hopper, the tobacco particles of different physical characteristics are neither uniformly nor continuously distributed within the stream generated by the distributor. This would lead to the production of a non-uniform tobacco filler (the result of which would be the formation of cigarettes of variable weight) if known manufacturing machines did not normally use control units, in themselves extremely complicated and costly, which by recycling part of the tobacco leaving or entering the carding unit, tend to make the tobacco stream fed to the bottom of the suction conveyor as uniform as possible.

The presence of the control units not only makes known manufacturing machines extremely complicated and costly, but also makes it necessary to extremely accurately adjust all the members of such machines, thus preventing the construction of multiple manufacturing machines, i.e. manufacturing machines comprising several forming units for the so-called tobacco rod, which have at least part of their drive mechanism in common.

SUMMARY OF THE INVENTION

The object of the present invention is to provide a cigarette manufacturing machine which is free from the aforesaid drawbacks. The said object is obtained according to the present invention by a cigarette manufacturing machine of the continuous rod type comprising at least one manufacturing unit which itself comprises a suction conveyor for the formation of a continuous tobacco filler, the tobacco being fed to said suction conveyor by means of a distributor, characterized in that said distributor comprises, in combination, a first chamber, an inlet duct connected to said first chamber, a second chamber, a feed channel connecting said first and second chambers together, a feed unit extending along said feed channel, a third chamber, a carding unit disposed between said second and third chambers, and an ascending outlet duct closed at the top by said suction conveyor and communicating with said third chamber and with means for feeding a stream of compressed air, said carding unit comprising a first and a second carding roller, the first disposed below the second and substantially tangential to each other, and said second chamber comprising a base wall disposed substantially tangential to an upper generating line of said first carding roller and defined, at least partly, by a belt consisting of the upper branch of a conveyor belt movable towards said carding unit; control means being provided for controlling the tobacco level in at least one of said first and second chambers, and first, second and third operating means being mounted on the distributor for operating said feed unit, the conveyor belt and said carding unit respectively.

BRIEF DESCRIPTION OF THE DRAWINGS

Further characteristics and advantages of the present invention will be apparent from the description given hereinafter with reference to the accompanying drawings, which illustrate one nonlimiting embodiment thereof, in which.

DETAILED DESCRIPTION OF THE INVENTION

Figure 2:
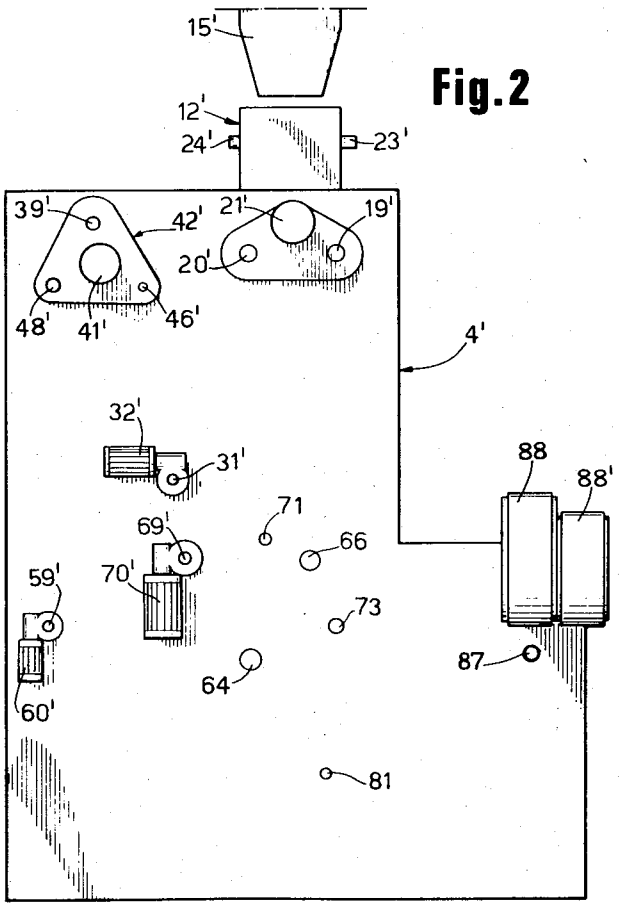
FIG. 2 is a second elevational side view of the machine of FIG. 1.
Figure 1:
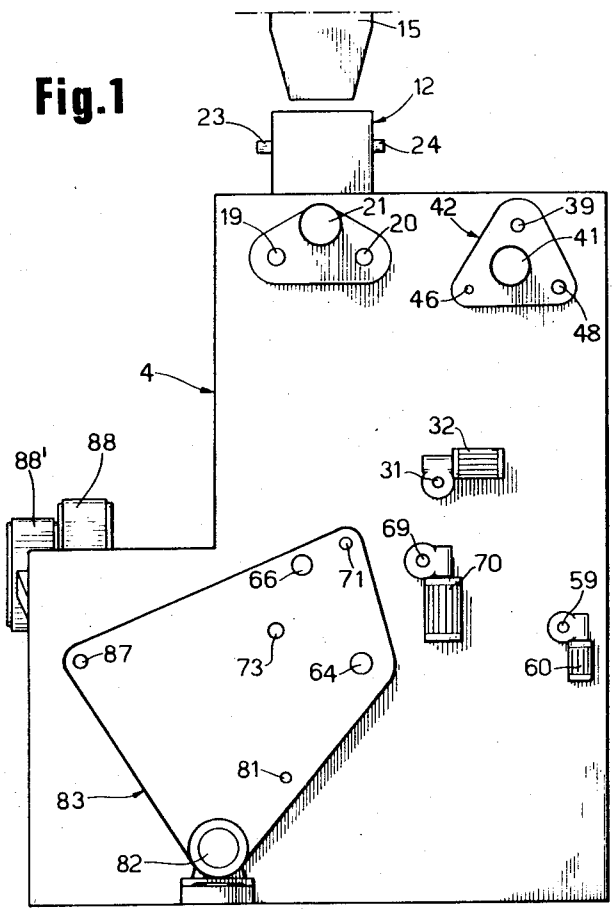
FIG. 1 is a first elevational side view of a manufacturing machine constructed according to the present invention.
Figure 3:
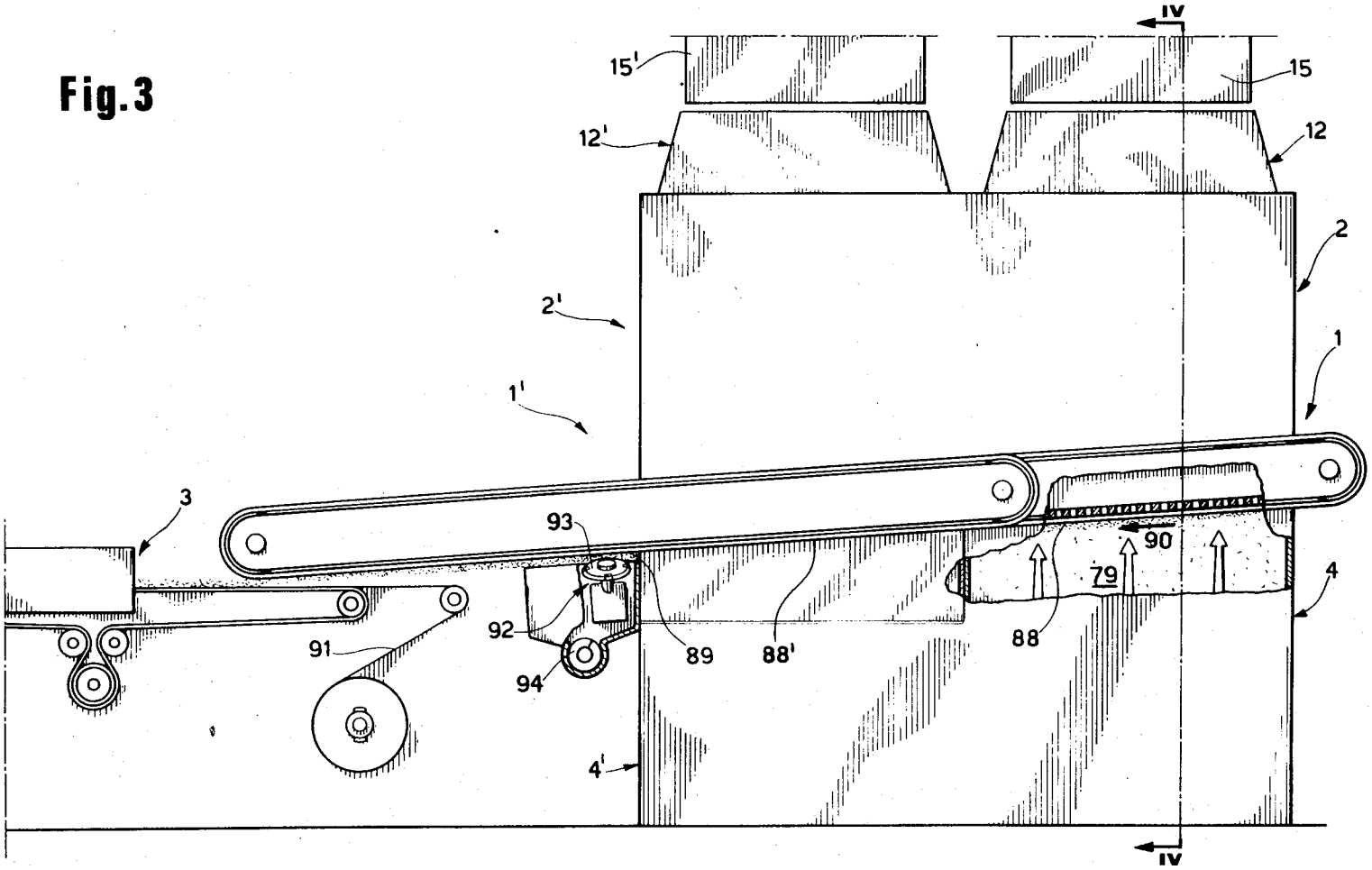
FIG. 3 is a diagrammatic frontal view of the machine of FIG. 1 with parts in section and parts removed for clarity.

FIGS. 1 and 2 and, in particular, FIG. 3 show a manufacturing machine comprising two manufacturing units indicated by 1 and 1' respectively. As the said manufacturing units are substantially identical, the description given hereinafter refers only to the single manufacturing unit 1, the component parts of the manufacturing unit 1' being indicated in the accompanying figures by reference numerals equal to those which distinguish the corresponding parts of the unit 1, but followed by the prime (') symbol. In addition, the common parts of the two units 1 and 1' are indicated on the accompanying drawings by reference numerals without an index.

The manufacturing unit 1 comprises a distributor 2, the purpose of which is to form a continuous uniform stream of tobacco particles from a mass of shredded tobacco, and a sectioon 3 (on the left with reference to FIG. 1), which is fed by the distributor 2, its purpose being to form a continuous cigarette rod. The component members of the distributor 2 are contained in a vertically extending casing 4 which has a lower zone disposed in a position facing the section 3.

Figure 4:
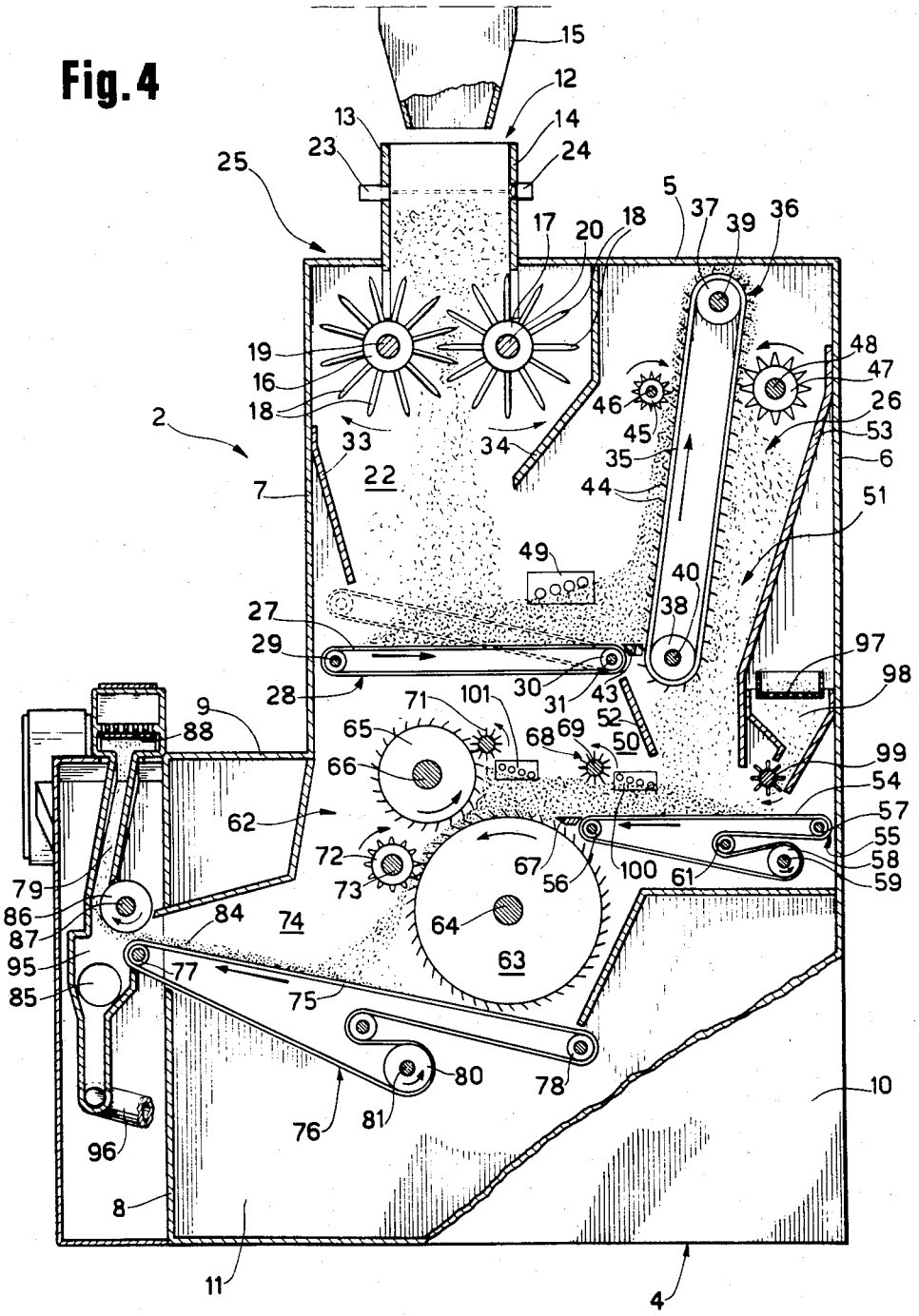
FIG. 4 is a section on the line IV—IV of FIG. 3.

With reference to FIG. 4, the casing 4 is closed at the top by a horizontal wall 5, and laterally by a right hand vertical wall 6 and two vertical walls, indicated from the top downwards by 7 and 8, which are connected by a horizontal wall 9. The walls 8 and 9 define the widened zone of the casing 4. On the two sides parallel to the plane of FIG. 2, each casing 4 is closed by a front wall 10 and a rear wall 11, this latter being in common with the casing 4'. The upper wall 5 comprises an aperture for the passage of an inlet duct 12 of rectangular cross-section, of which FIG. 4 shows two walls 13 and 14 parallel to the walls 6 and 7.

Conventional feed means, indicated diagrammatically by a conduit 15, feed a mass of shredded tobacco through the duct 12 to the distributor 2. At the outlet of the duct 12, inside the casing 4, there are provided two rollers 16 and 17 fitted all around with radial teeth 18 and keyed on to respective horizontal shafts 19 and 20 rotated by a motor 21. By rotating in opposite directions to each other, the rollers 16 and 17 perform a preliminary carding operation on the tobacco, and convey it towards an underlying chamber 22.

The lower ends of the walls 13 and 14 are of comb shape, and extend between the teeth 18 so as to oppose the descent of the tobacco outside the passage defined by the rollers 16 and 17. A light emitting element 23 and a photoelectric cell 24 for controlling the tobacco level in the duct 12 are supported by the walls 13 and 14, and control regulating means (not shown) for the tobacco stream fed by the conduit 15.

The duct 12 and the rollers 16 and 17 define together a prefeed unit 25, and lie above the chamber 22, which is bounded by a feed unit 26 comprising a belt 27 disposed at the base of the chamber 22 and consisting of the upper run of a belt 28 which passes endlessly over end rollers 29 and 30, the second of which is keyed on to a shaft 31 rotated (clockwise in FIG. 4) by a respective motor 32. Adjustment means, not shown, disposed between the axis of the roller 29 and the walls 10 and 11 enable the slope of the belt 27 to be adjusted. Two inclined converging walls 33 and 34, the first of which is rigid with the vertical wall 7 and the second of which is connected by means of a vertical portion of the upper wall 5, convey the tobacco descending from the prefeed unit 25 mainly on to the upstream end of the belt 27.

On the side opposite the wall 33, the chamber 22 is bounded by an elevator belt 35 forming part of the feed unit 26 and consisting of the rising run of a belt 36 which is wound endlessly over two end rollers 37 and 38 keyed on to respective shafts 39 and 40, the first of which is rotated (clockwise in FIG. 4) by a motor 41, by way of a reduction gear 42. The roller 38 is separated by a bridge 43 from the downstream end of the belt 27, and the roller 37 is close to the upper wall 5 of the casing 4. Teeth or blades 44 are fitted to the belt 36, and are inclined in the direction of its movement. The tobacco which has descended from the prefeed unit 25 and accumulated on the belt 27 is raised by the belt 35 by means of the blades 44 as far as its upper end.

In proximity to the roller 37, a bladed roller 45 forming part of the feed unit 26 and keyed on to a shaft 46 rotated (clockwise in FIG. 4) by the reduction gear 42, reduces the tobacco transferred by the elevator belt 35 to a substantially uniform layer. Immediately downstream of the roller 37, along the descending branch of the belt 36, there is provided a toothed roller 47 forming part of the feed unit 26 and keyed on to a shaft 48 rotated (anticlockwise in FIG. 4) by the reduction gear 42. Inside the chamber 22 there is disposed a sensor device 49, described in detail hereinafter, which controls the speed of the motor 21, i.e. the stream of tobacco entering the chamber 22, in accordance with the level attained by the tobacco inside this latter.

The roller 47 removes the tobacco layer from the blades 44 of the belt 36, and projects it in the form of separate particles towards an underlying chamber 50, by way of a feed channel 51 defined on one side by a descending run of the belt 36 followed by a fixed wall 52, and on the other side by a wall 53 fixed to the wall 6 and inclined from the top downwards towards the interior of the casing 4.

The chamber 50 comprises a base wall defined by a conveyor belt 54 consisting of the upper run of a belt 55 wound endlessly about two end rollers 56 and 57, the second of which is disposed in proximity to the wall 6. The reference numeral 58 indicates a drive roller for the belt 55, the shaft 59 of which is rotated (counterclockwise in FIG. 4) by a motor 60, and the reference numeral 61 indicates a tensioning roller.

Below the belt 27 and to the left of said belt 54, with reference to FIG. 4, there is disposed a carding unit 62 comprising a carding roller 63 keyed on to a shaft 64, rotating counterclockwise in FIG. 4, above which there is a roller 65, known as the brushing roller, which is keyed on to a shaft 66 rotating counterclockwise in FIG. 4 and disposed in a position of substantial tangency with respect to the roller 63.

The belt 54 is disposed substantially at the level of the summit of the carding roller 63, to which it is connected by means of a bridge 67. As a consequence of this arrangement, the tobacco poured by the overlying feed unit 26 on to the belt 54, is transferred by this latter by way of the bridge 67 on to the carding roller 63, in proximity to the zone of tangency between this latter and the brushing roller 65.

The reference numeral 68 indicates a bladed roller keyed on to a shaft 69 rotated (counterclockwise in FIG. 4) by a motor 70, its purpose being to level the tobacco accumulated within the chamber 50 in the transfer zone between the belt 54 and the carding roller 63.

A toothed roller 71, known as the cleaning roller, rotating counterclockwise position in FIG. 4, is in the chamber 50 substantially tangent substantial tangency with the roller 65 above the zone of contact between this latter and the tobacco mass. The purpose of the roller 71 is to remove the tobacco particles adhering to the surface of the brushing roller 65 and to hurl them into the chamber 50 again.

The carding roller 63 transfers to the outside of the chamber 50, downstream of its position of tangency with the brushing roller 65, a layer of tobacco having a thickness substantially equal to the radial dimensions of its teeth. A toothed roller 72, known as the picking roller, is keyed on to a shaft 73, and withdraws the tobacco layer from the roller 63, to project it in the form of separate particles into a chamber 74, the base wall of which is defined by a belt 75, known as the collection belt, which with reference to FIG. 4 moves from right to left, and is inclined upwards in the direction of its motion.

The belt 75 consists of the upper run of a belt 76 which is endless about end rollers 77 and 78, the second of which is disposed substantially in vertical alignment with the roller 56 of the belt 55, and the first of which is disposed in proximity to the lower end or mouth of an ascending duct 79. The belt 76 is driven by a roller 80 keyed on to a shaft 81 rotated (counterclockwise in FIG. 4) by a motor 82 by way of a reduction gear 83, to which the shafts 64, 66 and 73 and the roller 71 are also connected.

The tobacco particles thrown by the roller 72 form a layer 84 of substantially uniform thickness on the belt 75. At the downstream end of the band 75, the layer 84 is disposed in the form of separate particles, by a rising air stream generated by a source of compressed air, not shown, and fed through a conduit 85, and with the aid of a roller 86 rotating clockwise in FIG. 4, along the ascending duct 79. The roller 86 is mounted on a shaft 87 which is also connected to the reduction gear 83.

At the upper end of the duct 79 (see also FIG. 3), the tobacco particles adhere to the lower face of a suction conveyor belt 88 on which they form a layer or filler 89 by accumulation. The suction belt 88, movable in the direction of the arrow 90 of FIG. 3, transfers the tobacco filler 89 from the duct 79 to the section 3.

The so-called continuous cigarette rod is formed at the section 3 by wrapping the filler 89 in a paper web 91. During its transfer by the suction belt 88 to the section 3, the tobacco filler 89 is subjected, by a trimmer device 92 (FIG. 3), to an operation the purpose of which is to make its height or thickness substantially uniform. The trimmer device 92 is normally a pair of counterrotating discs 93 (one of which is shown in FIG. 3), with each provided with cutting edges.

The reference numeral 94 in FIG. 3 indicates a collection conduit for the tobacco detached from the filler 89 by the trimmer device 92. Below the duct 79 there is disposed a chamber 95 for collecting tobacco particles which, because of their weight, are not able to reach the suction belt 88.

A conduit 96 conveys tobacco particles which have fallen into the compartment 95, to a sieve container 97 disposed above an inlet duct 98 communicating with the chamber 50 by way of a lower mouth, the section of which is controlled by a bladed roller 99 disposed above the belt 54 upstream of the outlet of the channel 51.

Two sensor devices 100 and 101, analogous to the sensor device 49, are disposed in the chamber 50, the first above an intermediate zone of the belt 54 and the second above the carding roller 63 in proximity to the zone of tangency of this latter with the brushing roller 65. The devices 100 and 101 vary the speed of the motors 32 and 41 and of the motor 60 respectively, in accordance with the level attained by the tobacco inside the chamber 50.

When in operation, the separate tobacco particles originating from the feed unit 26 are collected on the horizontal belt 54 in such a manner as to form, on this latter, a continuous layer of tobacco having a relatively small thickness controlled by the sensors 100 and 101. This continuous layer is fed, substantially without any shocks or turning movements, by the belt 54 until it reaches the zone of tangency between the rollers 63 and 65, which together with the roller 72 feed it on to the band 75. From the aforegoing, it will be noted that when the tobacco has been fed into the chamber 50, it is removed immediately therefrom by a continuous action. Consequently, the tobacco is not subjected inside the chamber 50 to the compression and remixing actions which are the cause of the innumerable drawbacks stated in the introduction. Furthermore, it should be noted that the uniformity of the tobacco layer which reaches the carding rollers 63 and 65 enables any adjustment of the carding unit 62 or of any of the members disposed downstream thereof to be dispensed with, thus enabling two or more manufacturing units to be at least partly coupled together, as shown in FIGS. 1 and 2. In this respect, these figures, as stated, relate to two manufacturing units 1 and 1' which are provided with respective motors 21, 32 and 41 and 21', 32' and 41', whereas they possess the common motor 82 for operating the rollers 63, 65, 71, 72, 80 and 86, and the rollers 63', 65', 71', 72', 80' and 86' respectively. For this purpose, all these rollers are supported in pairs by respective through shafts extending to both units 1 and 1'. Obviously, each unit 1 can either be used separately, or can be used coupled to one or more units 1' in the manner described.

One of the constructional characteristics which, together with the belt 54, contributes most to obtaining a uniform layer of tobacco at the inlet to the carding unit 62 is the particular sensor devices 100 and 101 used. As shown in FIG. 4, these sensors are preferably each consist of an inclined row of photosensitive elements, which enable the speed of the belts 38, 36 and 55 to be very accurately adjusted, these belts enabling, in this manner, to avoid any problem upstream with the carding unit 62 which could adversely affect the uniformity of the tobacco stream.

What we claim is:

1. A cigarette manufacturing machine of the continuous rod type comprising at least one manufacturing unit (1) which itself comprises a suction conveyor (88) for the formation of a continuous tobacco filler, the tobacco being fed to said suction conveyor (88) by means of a distributor (2), characterized in that said distributor (2) comprises, in combination, a first chamber (22), an inlet duct (12) connected to said first chamber (22), a second chamber (50), a feed channel (51) connecting said first chamber (22) and second chamber (50) together, a feed unit (26) extending along said feed channel (51), a third chamber (74), a carding unit (62) disposed between said second chamber (50) and third chamber (74), and an ascending outlet duct (79) closed upperly by said suction conveyor (88) and communicating with said third chamber (74) and with feed means (85) for a stream of compressed air, said carding unit (62) comprising a first carding roller (63) and a second carding roller (65), the first disposed below the second and substantially tangential to each other, and said second chamber (50) comprising a base wall disposed substantially tangential to an upper generating line of said first carding roller (63) and defined, at least partly, by a belt (54) constituted by the upper run of a conveyor belt (55) movable towards said carding unit (62); control means (49, 100–101) being provided for controlling the tobacco level in at least one of said first chamber (22) and second chamber (50), and first, second and third operating means (41, 60, 82) being mounted on said distributor for operating said feed unit (26), said conveyor belt (55) and said carding unit (62) respectively.

2. A manufacturing machine as claimed in claim 1, characterized in that each said manufacturing unit (1) also comprises a further tobacco inlet duct (98) which communicates with said second chamber (50).

3. A manufacturing machine as claimed in claim 2, characterized in that said further inlet duct (98) is disposed facing a position of said rear wall (54) disposed upstream of an outlet end of said feed channel (51) in the feed direction of said conveyor belt (54).

4. A manufacturing machine as claimed in claim 3, characterized in that said further inlet duct (98) communicates with said ascending duct (79).

5. A manufacturing machine as claimed in claim 3, characterised in that said further inlet duct (98) communicates with a compartment (94) disposed below said suction conveyor (88) and downstream of said ascending duct (79).

6. A manufacturing machine as claimed in claim 1, characterised in that said base wall (54) is horizontal and is disposed with one end thereof in a position substantially corresponding with a zone of tangency between said carding rollers (63, 65).

7. A manufacturing machine as claimed in claim 1, characterised in that each said manufacturing unit (1) comprises a prefeed unit (25) which itself comprises two counter-rotating toothed rollers (16–17) disposed in said first chamber (22) below said inlet duct (12), further control means (49) being provided for controlling fourth operating means (21) connected to said prefeed unit (25), in accordance with the level attained by the tobacco inside said first chamber (22).

8. A manufacturing machine as claimed in claim 1, characterised in that said first chamber (22) comprises a base wall constituted by a belt (27) mobile towards said feed unit (26) and operated by respective fifth operating means (32).

9. A manufacturing machine as claimed in claim 1, characterised in that each said control means (49, 100–101) comprises a plurality of photosensitive elements disposed in at least one line.

10. A manufacturing machine as claimed in claim 1, characterised by comprising at least two said manufacturing units (1—1'), said third operating means (82) being common to both said manufacturing units (1—1').

* * * * *